US007380848B2

(12) United States Patent
Petruzelli

(10) Patent No.: US 7,380,848 B2
(45) Date of Patent: Jun. 3, 2008

(54) LATERALLY ADJUSTABLE SNOW SHOVEL REINFORCED BY BRACES

(76) Inventor: Rocco Petruzelli, 2 Lady Godiva Way, New City, NY (US) 10956

( * ) Notice: Subject to any disclaimer, the term of this patent is extended or adjusted under 35 U.S.C. 154(b) by 256 days.

(21) Appl. No.: 11/271,379

(22) Filed: Nov. 12, 2005

(65) Prior Publication Data

US 2007/0108783 A1 May 17, 2007

(51) Int. Cl.
*E01H 5/02* (2006.01)
*A01B 1/22* (2006.01)

(52) U.S. Cl. ..... 294/54.5; 294/53.5; 294/57

(58) Field of Classification Search ..... 294/51, 294/53.5, 54.5, 57; 37/265, 278, 284, 285
See application file for complete search history.

(56) References Cited

U.S. PATENT DOCUMENTS

| | | | | | |
|---|---|---|---|---|---|
| 323,656 | A | * | 8/1885 | Franz | 37/274 |
| 813,983 | A | | 2/1906 | Luney | |
| 1,196,206 | A | | 8/1916 | Bulger et al. | |
| 1,524,639 | A | * | 1/1925 | Grady | 37/284 |
| 1,666,334 | A | * | 4/1928 | Larson | 37/280 |
| 1,820,692 | A | * | 8/1931 | Cooper | 37/274 |
| 2,463,150 | A | | 3/1949 | Camp | |
| 2,565,466 | A | * | 8/1951 | Barker | 294/57 |
| 2,803,071 | A | | 8/1957 | Pochopien | |
| 2,896,993 | A | | 7/1959 | Pollock | |
| 2,919,153 | A | | 12/1959 | Benton | |
| 2,967,363 | A | * | 1/1961 | Meier | 37/283 |
| 4,538,847 | A | | 9/1985 | Lapshansky | |
| 4,550,943 | A | * | 11/1985 | Mirto | 294/54.5 |
| 4,559,726 | A | | 12/1985 | Moisan | |
| 5,048,883 | A | | 9/1991 | Waluk | |
| 5,440,828 | A | | 8/1995 | Simpson | |
| D373,292 | S | * | 9/1996 | Motley | D8/10 |
| 5,829,808 | A | | 11/1998 | Colla | |
| 5,984,393 | A | | 11/1999 | Washington | |
| 6,457,757 | B2 | | 10/2002 | Hendrick | |
| 6,675,507 | B2 | | 1/2004 | Petruzelli | |

* cited by examiner

*Primary Examiner*—Dean J Kramer
(74) *Attorney, Agent, or Firm*—Notaro & Michalos P.C.

(57) ABSTRACT

A shovel includes a handle assembly being pivotally connected to a blade or a bracket of a blade for pivoting between a first position or second position at a first or second acute angle between the blade axis and the handle axis. The blade also has a third position at substantially a right angle between the handle axis and the blade axis. A pair of braces are attached to the blade. A plurality of holes are provided at the upper end of the pair of braces, wherein one hole of the first cross brace is aligned with one hole of the second cross brace for establishing each of the first, second, and third positions of the blade.

7 Claims, 11 Drawing Sheets

LATERALLY ADJUSTABLE SNOW SHOVEL REINFORCED BY BRACES

FIELD AND BACKGROUND OF THE INVENTION

The present invention relates generally to the field of snow shovels and in particular to a new and useful snow shovel having a pair of braces which reinforce an angled snow shovel blade.

Several patents teach angle adjustable blades for shovels. One such patent teaches a shovel blade that is adjustable via braces. U.S. Pat. No. 2,896,993, discloses a pair of braces which are separately attached to opposite sides of a shovel blade at their lower end and converge together at their upper end to be connected to a handle via a pivot pin. However, the braces are not adjustable with respect to each other to change the angle of the blade. Rather, the angle of the blade is changed based on pivoting caused by rotation or twisting of the handle.

U.S. Pat. No. 5,440,828 to Simpson discloses a shovel comprising a blade having a rear bracket pivotally connected to a handle via a handle pivot pin or bolt so that the handle can be moved to an obliquely angled position with respect to the blade. A frame having an arched transverse member and a restraining bar lying horizontally between opposite substantially vertical sides of the transverse member define a channel for receiving the handle. The handle is pivotable via the pivot pin or bolt, and therefore slidable inside the channel over a range of angular positions oblique to each side of the shovel limited by the length of the channel.

U.S. Pat. No. 2,463,150 discloses a shovel having a blade with an H-frame attached to its rear, and a bracket journalled upon the legs of the H-frame. A handle contains a dial at its lower end attached to the bracket via a screw, wherein the dial has holes arranged in an outer circle of the dial. The handle is titled laterally at an angle with respect to the bracket, and a stud fixed upon the bracket, is inserted through the center dial hole to maintain the angle of the handle with respect to the bracket. The handle can also be articulated away from the blade via a pivotal rod and attached to a clamping lever.

U.S. Pat. No. 813,983 and U.S. Pat. No. 5,829,808 disclose a shovel with the shovel blade pivotally attached to the handle so that the blade can tilt to the left or right. The blade is connected to the handle by two bolts or screws arranged vertically. The upper bolt is mounted through an arcuate slot in the shovel blade, while the lower bolt is the pivot point. In a second embodiment in U.S. Pat. No. 813,983, the blade is reversed so that the lower bolt is mounted through an arcuate slot and the upper bolt is the pivot point. Thus, the edges of the blade can be tilted off horizontal, theoretically to cause snow to move to one side when the shovel is used as a plow. However, it appears that if the bottom edge is not flat, some snow would remain behind when using the shovel in this manner.

U.S. Pat. No. 1,196,206 discloses a scoop or scraper which may be adjusted laterally with respect to a handle via a pivoting connection comprising an eye hook having a shank riveted to the scoop which passes through an eye in a connecting member of the handle. A wingnut restrains a bail contained in a notch and connected to the rear face of the scoop, which can be loosened to allow the bail to slip through the notch as the scoop is adjusted laterally.

The following patents also disclose laterally adjustable shovel blades, and are listed for general reference: U.S. Pat. Nos. 2,803,071, 2,919,153, 4,538,847, 4,559,726, 5,984,393, 6,457,757, 6,675,507, and 6,948,268.

Also, there are patents which disclose assembly of handles by pins connecting one handle portion to another handle portion. U.S. Pat. No. 5,048,883 discloses an adjustable rail of a handle arrangement comprising a lower tubular portion and an upper tubular portion slidable within the lower tubular portion, wherein both the upper and lower tubular portions have holes which can be aligned so that the upper tubular portion can be fixed with respect to the lower tubular portion a particular position by a screw fastener which is inserted through aligned holes of the respective tubular portions.

There is a need in the art for reinforcement for laterally adjustable blades of shovels. All of the prior art patents teach simple and delicate pivoting connections via pins, eye hooks, etc, without any type of reinforcement for preventing wobbling of the blade or the tendency for the blade to turn when snow is shoveled. The prior art fails to teach reinforcement for laterally adjustable blades which can also be used as support or leverage during shoveling.

SUMMARY OF THE INVENTION

It is an object of the present invention to provide a snow shovel with a reinforced angle adjusted blade for preventing the blade from turning or wobbling when snow is shoveled.

It is a further object of the present invention to provide reinforcement for an angle adjustable blade which can also be used for support or leverage during shoveling.

Accordingly, a shovel is provided which includes a handle assembly being pivotally connected to a blade for pivoting between a first position at a first acute angle between the horizontal blade axis and the substantially vertical handle axis and a second position at a second acute angle between the horizontal blade axis and the substantially vertical handle axis. The blade also has a third position at substantially a right angle between the substantially vertical handle axis and the horizontal blade axis.

The shovel includes a pivoting means for pivoting the handle assembly with respect to the blade. The pivoting means includes either a bracket that pivots with respect to the blade or a bracket that is permanently attached to the blade but is also pivotally connected to the lower handle assembly. If the pivoting means is a bracket that pivots with respect to the blade, the area of pivotal connection is in the center of the blade. If the pivoting means is a bracket that is permanently attached to the blade but is pivotally connected to the lower handle assembly, the area of pivotal connection is between an upper bracket region and the lower handle assembly.

A pair of braces having a hole at their lower end are attached via fasteners to holes on opposites sides of a center vertical axis of the blade. A plurality of holes are provided along a vertical axis at the upper end of the pair of braces, wherein one hole of the first cross brace is aligned with one hole of the second cross brace for establishing each of the first, second, and third positions of the blade. The holes at the upper end of the cross braces are aligned with and connected to a stem of the handle assembly at a bracing location. The stem is attached at its lower end to the bracket and its upper end to a handle.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1A:
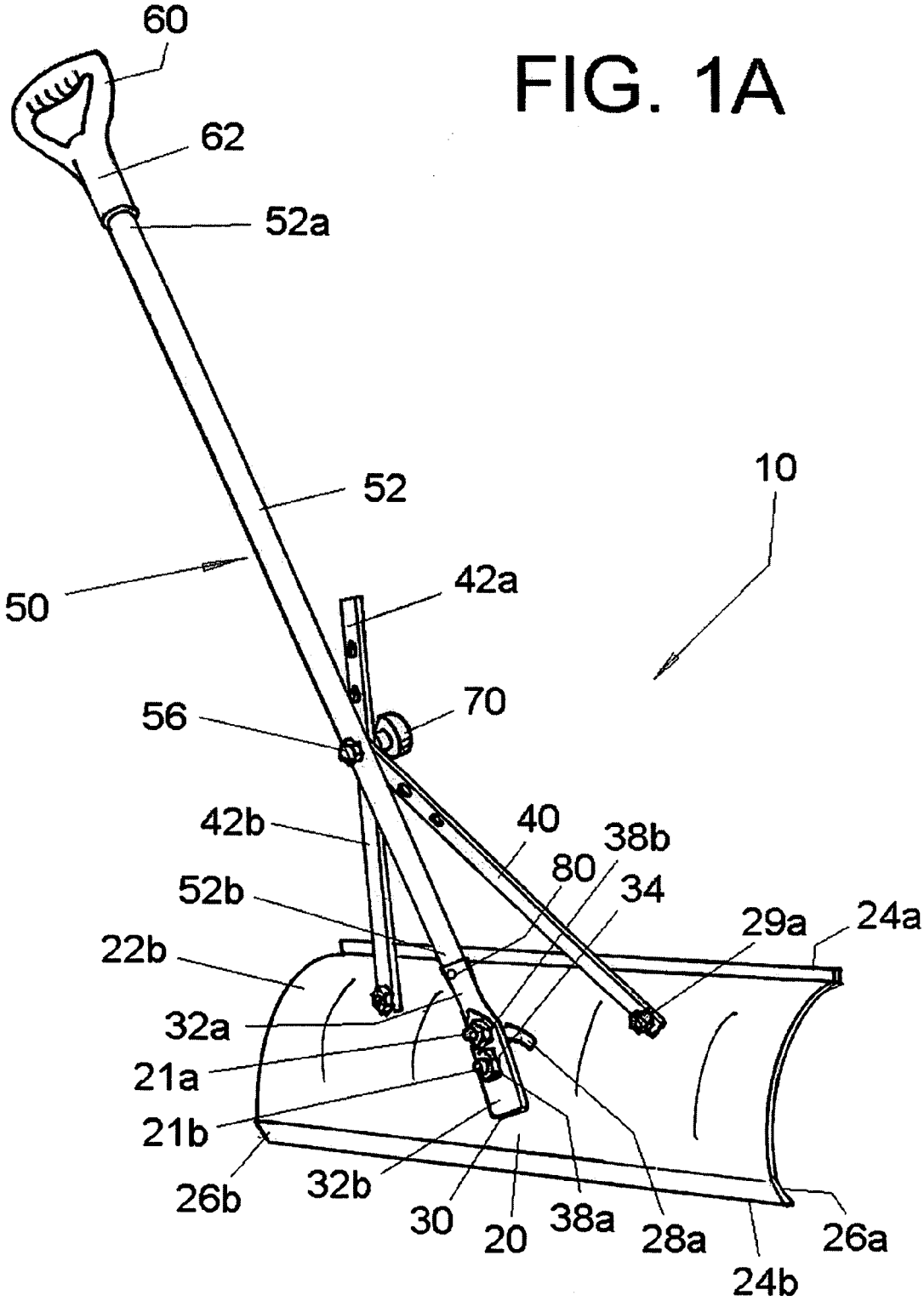
FIG. 1A is a perspective rear view of the shovel of the present invention.
Figure 1B:
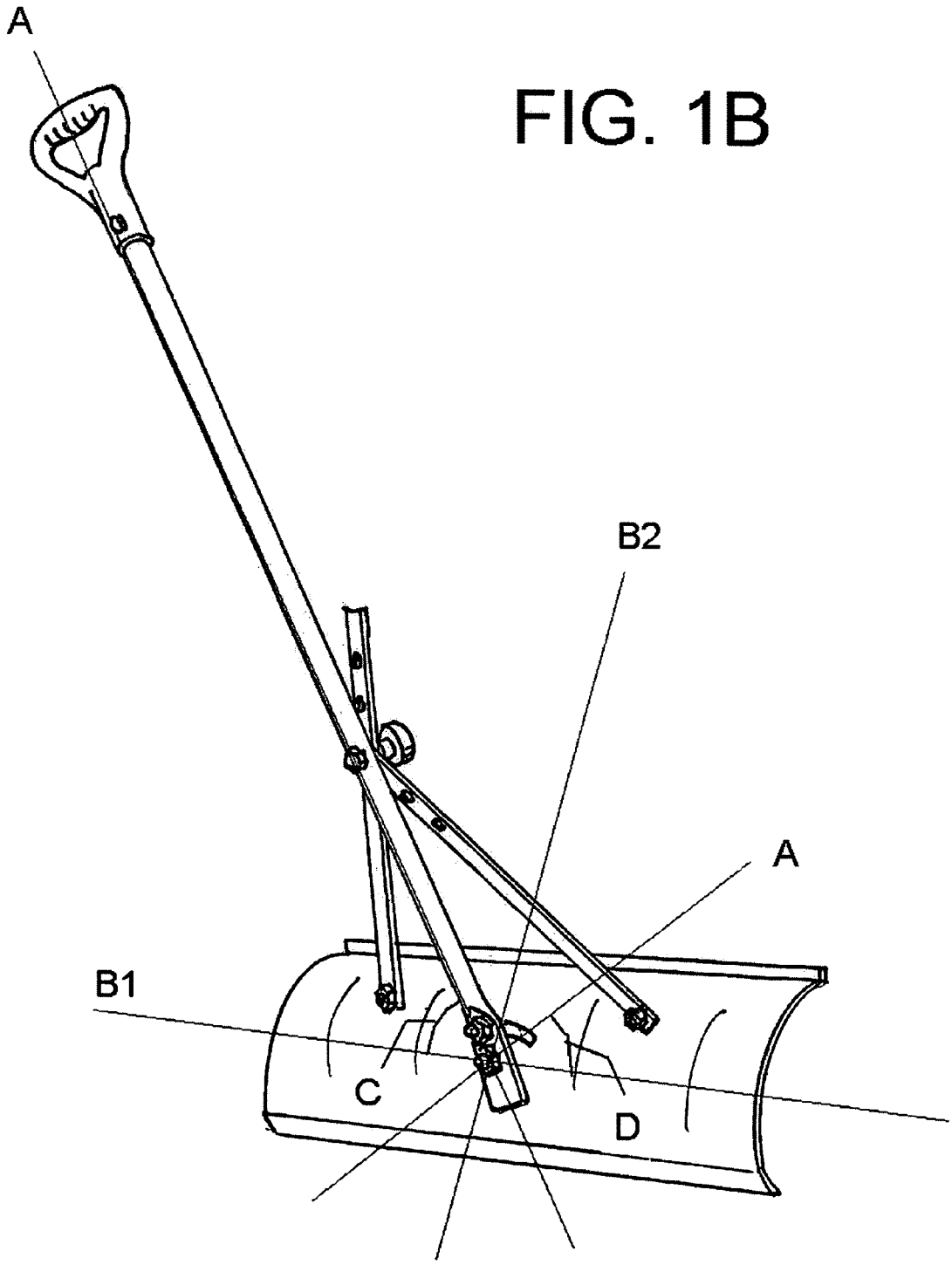
FIG. 1B is a view like FIG. 1A but showing the various axes and angles of the invention.

Referring now to the drawings, in which like reference numerals are used to refer to the same or similar elements, FIGS. 1A-1B show a manual shovel 10 for snow or ice removal and the like, comprising a blade 20 pivotally connected to a bracket 30 and also attached to a pair of cross braces 40. A handle assembly 50 is connected to the bracket 30.

Figure 2:
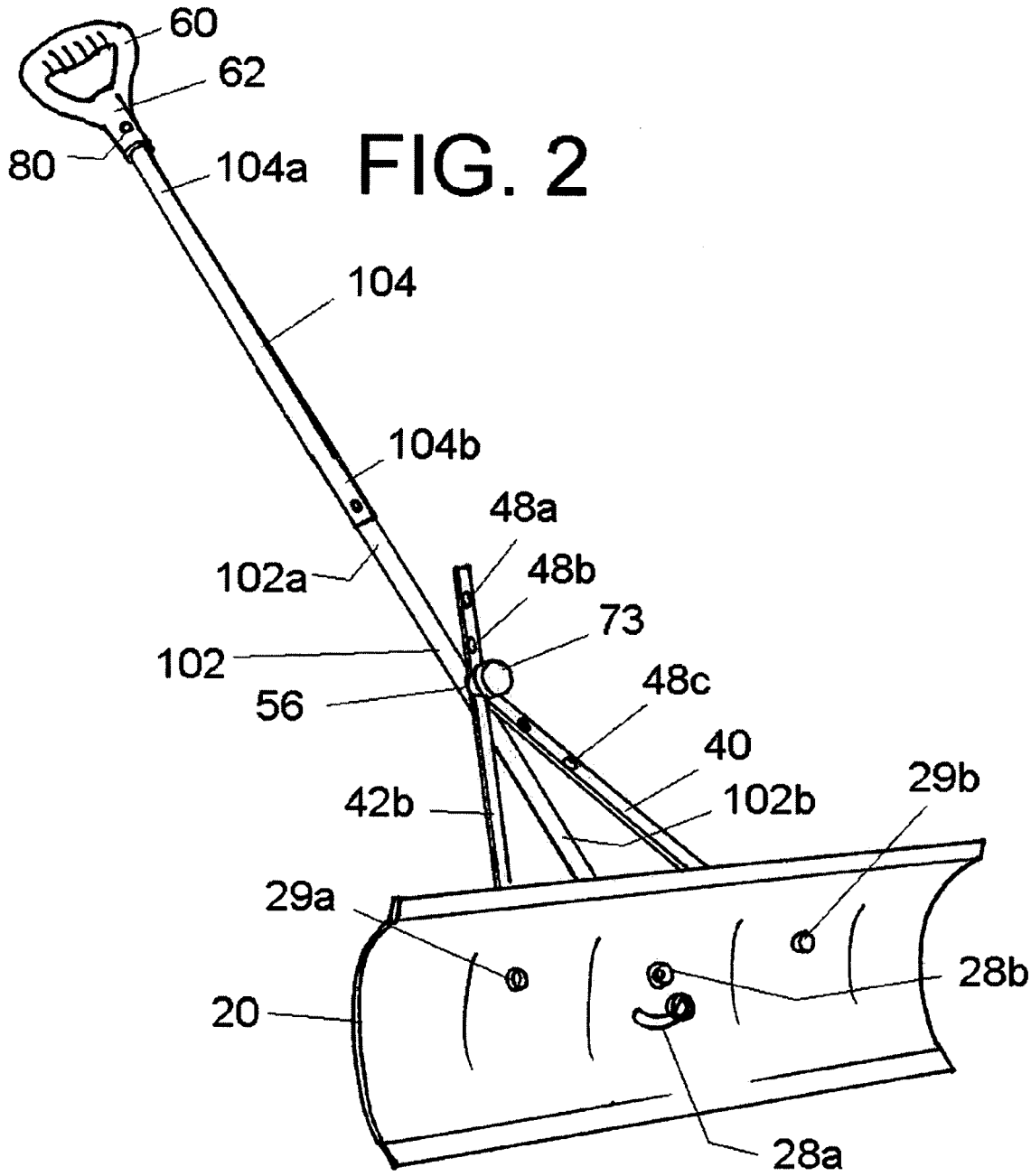
FIG. 2 is a perspective front view of the shovel of the present invention with a variety of alternative features.

The blade 20 is substantially arcuate and includes a front face and a rear face 22*b*, top and bottom ends 24*a* and 24*b*, and sides 26*a* and 26*b*. The blade 20 further includes a center horizontal axis B1 and a center vertical axis B2. The blade 20 includes one arcuate slot 28*a* and one hole 28*b* lying separately along the center vertical axis B2, wherein the arcuate slot 28*a* is positioned above the hole 28*b*. The arcuate slot 28*a* curves inwardly toward the hole 28*b*, or in other words, the ends of the slot 28*a* are curved down. It is not essential that the arcuate slot 28*a* be positioned above the hole 28*b*. As shown in FIG. 2 for example, the arcuate slot 28*a* may be positioned below the hole 28*b* as well, but the arcuate slot 28*a* must be arranged so that it curves inwardly toward the hole 28*b* , or in this case, the ends of the slot 28*a* are curved up. The blade 20 further includes holes 29*a* and 29*b* on opposite sides of the center vertical axis B2 for attachment to the cross braces 40 as will be described in further detail below. The body of the blade 20 between the ends 24*a* and 24*b* is substantially arcuate or concave. However, the arcuate shape of the blade 20 changes into a long leading planar edge near the bottom end 24*b*.

The bracket 30 has a top portion 32*a*, a bottom portion 32*b*, and a center pivoting point 34 between the top and bottom portions 32*a* and 32*b*. The bottom portion 32*b* is flattened while the top portion 32*a* is cylindrical. The flat bottom portion 32*b* contains at least two holes 38*a* and 38*b* (see FIGS. 3A, 3B) lying along a center vertical axis of the bracket 30, which are lined up with the arcuate slot 28*a* and hole 28*b* in the blade 20 for attachment of the bracket 30 to the blade 20 when the front face of the bracket bottom end is placed against the rear face of the blade 20.

For attachment of the bracket 30 to the blade 20, a pair of fasteners such as bolts 21*a* and 21*b* are inserted into the arcuate slot 28*a* and hole 28*b* from the front of the blade 20. The bolt 21*a* for the arcuate slot 28*a* has a head which is larger than the width of the arcuate slot 28*a* so that the bolt 21*a* cannot slip through the slot 28*a*, while the length of the bolt extends through the blade from the front side to the rear side of the blade, and through a corresponding hole 38*a* in the bracket 30. The head of the bolt rests against the front face of the blade. A nut is screwed onto the protruding length of the bolt from the rear of the bracket 30 and screwed against the rear of the bracket 30. The bracket 30 is thus freely pivotable in left and right directions along the arcuate slot 28*a*, but cannot be pivoted in any other direction due to the attachment via the bolts. The bracket 30 is pivotable between a first position on one side of the arcuate slot 28*a* at a first acute angle C between the handle axis A on one side of vertical, and the horizontal blade axis B1 and a second position (not shown in FIG. 2) on the opposite side of the arcuate slot 28*a* at a second acute angle D between the bracket axis A and the horizontal blade axis B1. The bracket also has a third position in the center of the arcuate slot 28*a* at a substantially right angle between the substantially vertical handle axis A and the horizontal blade axis B1.

A lock washer may be arranged between the rear face of the bracket bottom end and the nut screwed on the bolt length against the rear face of the bracket bottom. The lock washer, such as for example, a star-type lock washer helps to prevent the loosening of the nut.

The pair of cross braces 40 each have a top portion 42*a* and a bottom portion 42*b*. The bottom portions 42*b* each have a hole 46 (see FIGS. 3A, 3B) which are lined up with the holes 29*a* and 29*b* on opposites sides of the vertical center axis B2. The pair of cross braces also have at least three holes 48*a*, 48*b*, and 48*c* at the top portion.

For attachment of the cross braces 40 to the blade 20, a pair of fasteners such as bolts are inserted into the holes 29*a* and 29*b* from the front of the blade 20. The head of the bolts rest against the front face of the blade 20. A nut is screwed onto the protruding length of the bolt from the rear of the cross braces 40 and screwed against the rear of the cross braces 40. A lock washer may be arranged between the rear face of the cross brace bottom end and the nut screwed on the bolt length against the rear face of the cross brace bottom. The lock washer, such as for example, a star-type lock washer helps to prevent the loosening of the nut.

A handle assembly 50 includes a cylindrical stem 52 having a top portion 52*a* and a bottom portion 52*b*. The bottom portion 52*b* is connected to the cylindrical top portion 32*a* of the bracket 30 and the top portion 52*a* is connected to a handle 60. The bottom portion 52*b* has a smaller diameter than the top portion 32*a* and is inserted into the top portion 32*a*. Both the bottom portion 52*b* and the top portion 32*a* have corresponding holes such that when the bottom portion 52*b* is inserted into the top portion 32*a*, and the holes are aligned, a fastening means 80 can be used to secure the portions 52*b* and 32*a*. The fastening means 80 includes screws, bolts and nuts, or even depressible buttons biased by a resilient means such as a spring.

For example, the stem 52 has depressible buttons on opposite sides of the stem at the bottom portion 52*b*. The buttons are pushed into the stem and against a resilient means such as spring. The bracket 30 contains holes on opposite sides at its top portion 32*a*. When the bottom portion 52*b* of the stem 52 is inserted into the top portion 32*a* with the bottom portion buttons depressed, and the buttons reach the holes, the buttons expand out through the holes from the biasing force of the spring, locking the bottom portion 52*b* of the stem into the bracket 30.

The cross braces 40 are attached to stem 52 at a bracing location as follows. Both the top portion 42*a* of the braces and the bottom portion 52*b* of the stem have holes, which can be aligned, so that a long stove bolt 70 can be inserted through the holes upon alignment, to connect each of the cross braces to the stem at the bracing location. More specifically, the bottom portion 52*b* of the stem has one hole 56 and each of the braces has at least three holes, a first top hole 48*a*, a second middle hole 48*b*, and a third bottom hole 48*c*, which are arranged along a center vertical axis of the cross braces. The cross braces are adjusted to converge their top ends at the hole 56, where at least one hole from each of the cross braces overlaps the hole 56. This adjustment is made by pivoting the cross braces about the hole 29*a*, 29*b* to which they are respectively attached.

If the bolt 21*a* for connection of the bracket to the arcuate slot 28*a* is lined up in the center of the arcuate slot 28*a*, then the cross braces are adjusted to converge at the middle hole 48*b* of each of the cross braces. Once the middle holes 48*b* of the cross braces are aligned with the hole 56 in the stem, a long stove bolt 70 is inserted into the stem hole 56 and through the aligned cross brace middle holes 48*b*. A nut, wingnut, or the like screws onto the threaded opposite end of the stove bolt and rests against the cross braces. If the bolt 21*a* is moved to the leftmost end of the arcuate slot 28*a*, then the left cross brace is only adjusted so that the bottom hole 48*c* is aligned with the hole 56 of the stem and the right cross brace is adjusted so that the top hole 48*a* converges with the bottom hole 48*c* of the left cross brace and the hole 56. The stove bolt 70 and a nut or wingnut connect the hole 56 to the bottom hole 48*c* of the left cross brace and the top hole 48*a* of the right cross brace. In likewise fashion, the left and right cross braces may be adjusted if the bolt 21*a* is moved to the rightmost end of the slot 28*a*, so that the hole 56 is aligned with and connected to the top hole 48*a* of the left cross brace and the bottom hole 48*c* of the right cross brace.

The end of the top portion 52*a* of the stem 52 has external threads and a cylindrical base 62 of the handle 60 contains internal threads which cooperate with the stem external threads to screw the handle 60 onto the stem 52.

In a second embodiment shown in FIGS. 2-3, a screw knob 73 may be used in place of the stove bolt and nut combination to attach one of the holes 48*a*, 48*b*, 48*c* of each of the cross braces to the hole 56 of the stem.

Figure 4:
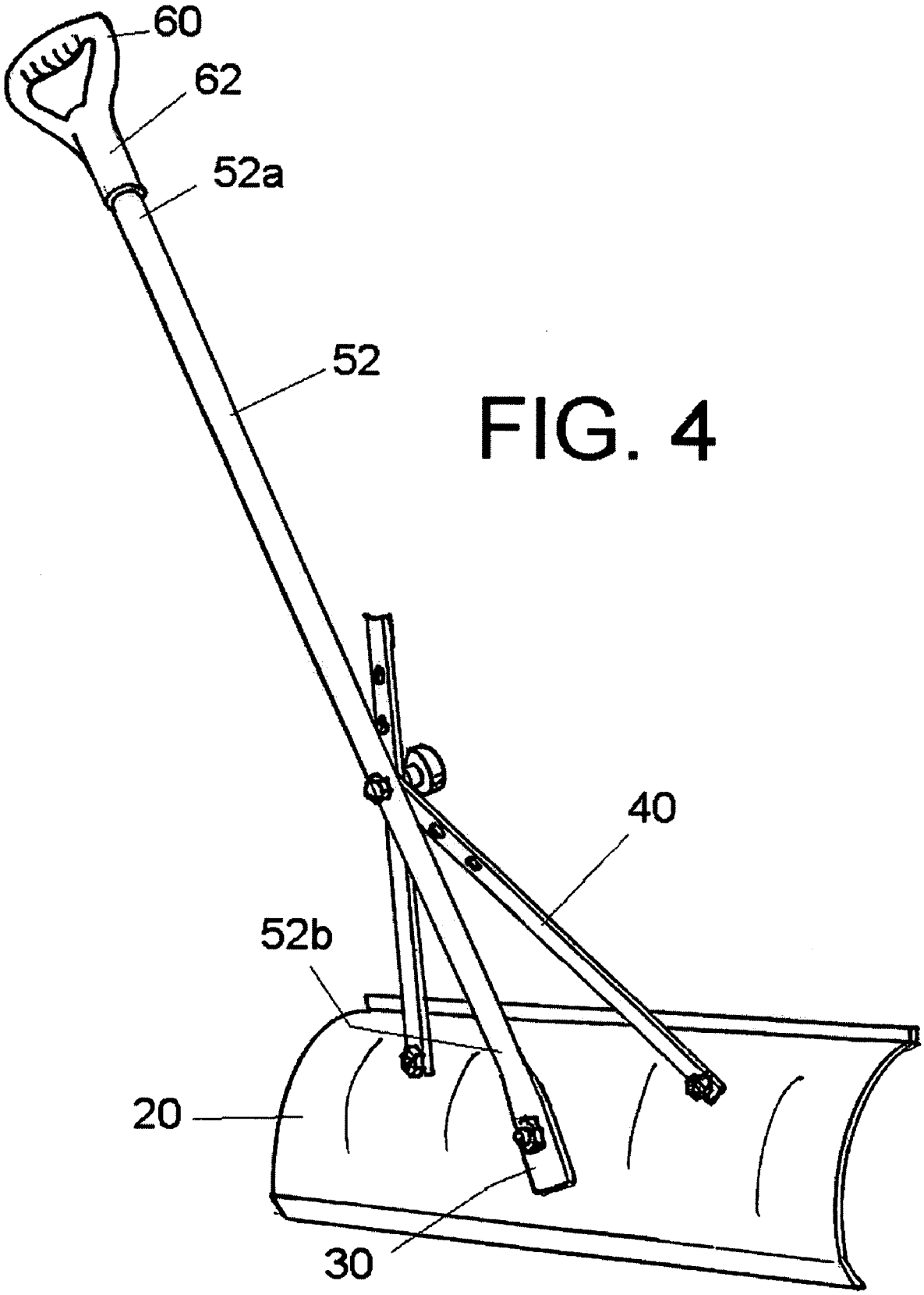
FIG. 4 is a rear perspective view of the shovel of the present invention without an arcuate slot.
Figure 5:
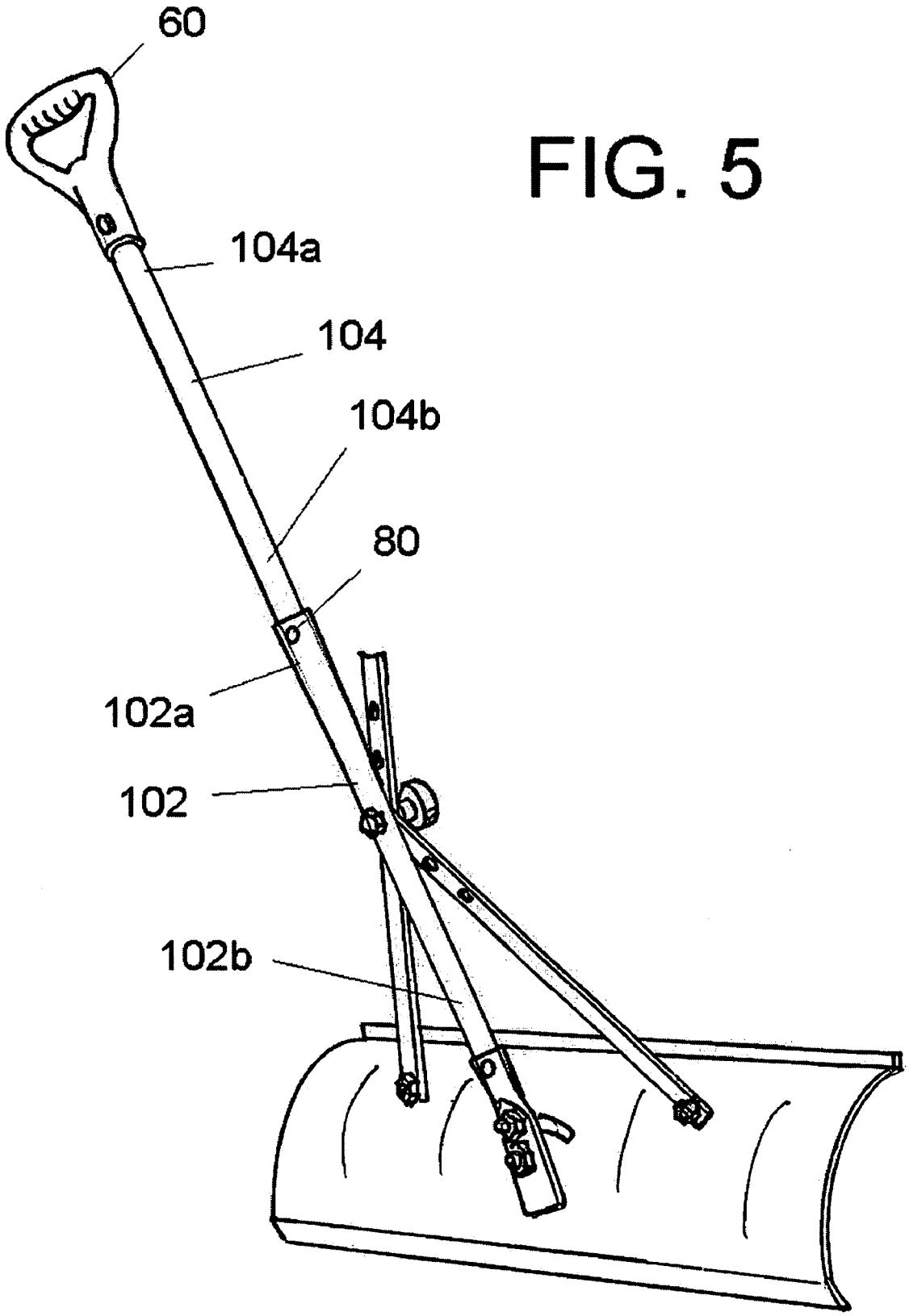
FIG. 5 is a rear perspective view of the shovel of the present invention having two stems.

In a third embodiment shown in FIG. 4, the bracket 30 is pivotally connected to the blade 20 only when the holes 38*b* and 28*b* of the bracket 30 and blade 20 respectively are aligned and fastened by a bolt and nut or other similar fastening means. There is no arcuate slot 28*a*.

In a fourth embodiment shown in FIGS. 2, 3A, 3B, and 5, two stems 102 and 104 are provided, wherein the bottom stem 102 has a bottom portion 102*b* and a top portion 102*a* and the top stem 104 has a bottom portion 104*b* and a top portion 104*a*. The top portion 102*a* attaches to the bottom portion 104*b*. The bottom stem 102 attaches to the top portion 32*a* of the bracket 30 via the bottom portion 102*b*. The top stem 104 attaches to the base 62 of the handle 60 via the top portion 102*a*. Attachment can be made via any of the means of attachment described above such as cooperation of depressible buttons with holes or bolts with nuts.

Figure 3A:
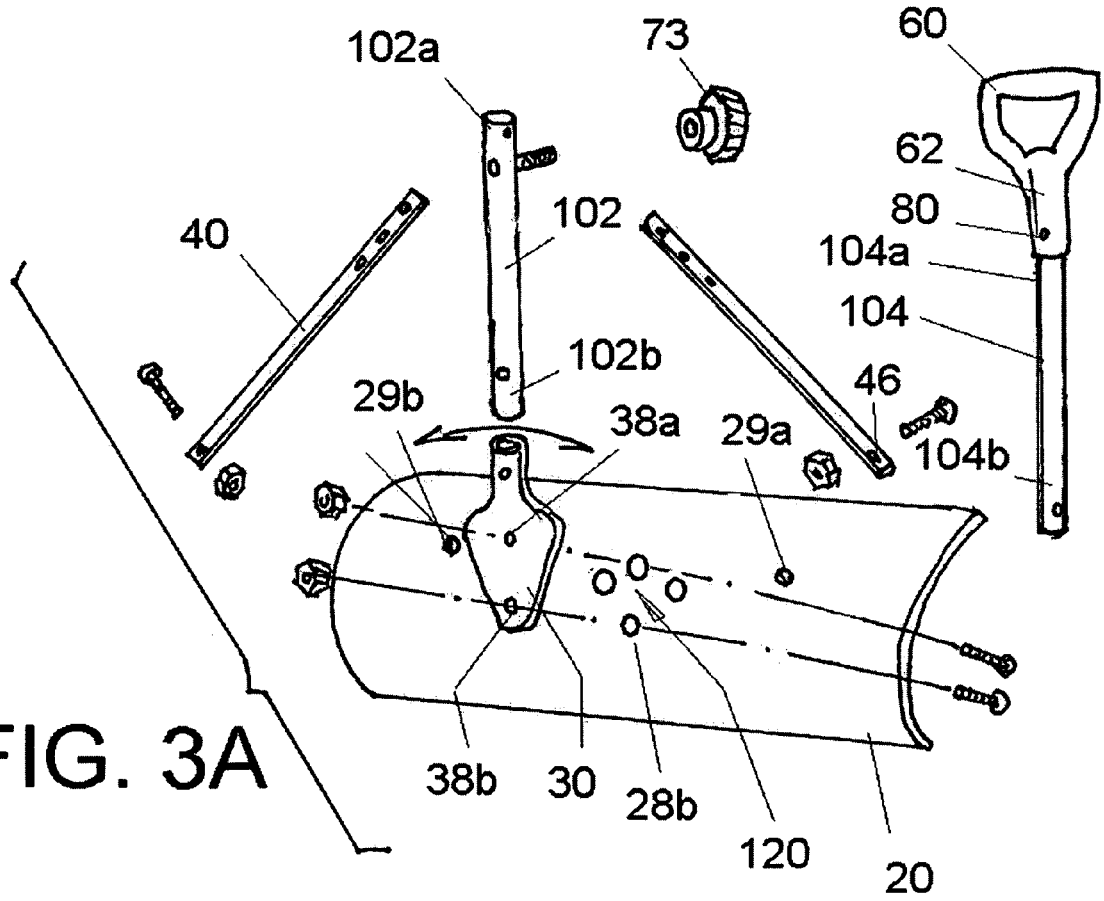
FIG. 3A is an exploded view of the components of the shovel where the blade contains an arcuately aligned set of holes.
Figure 3B:
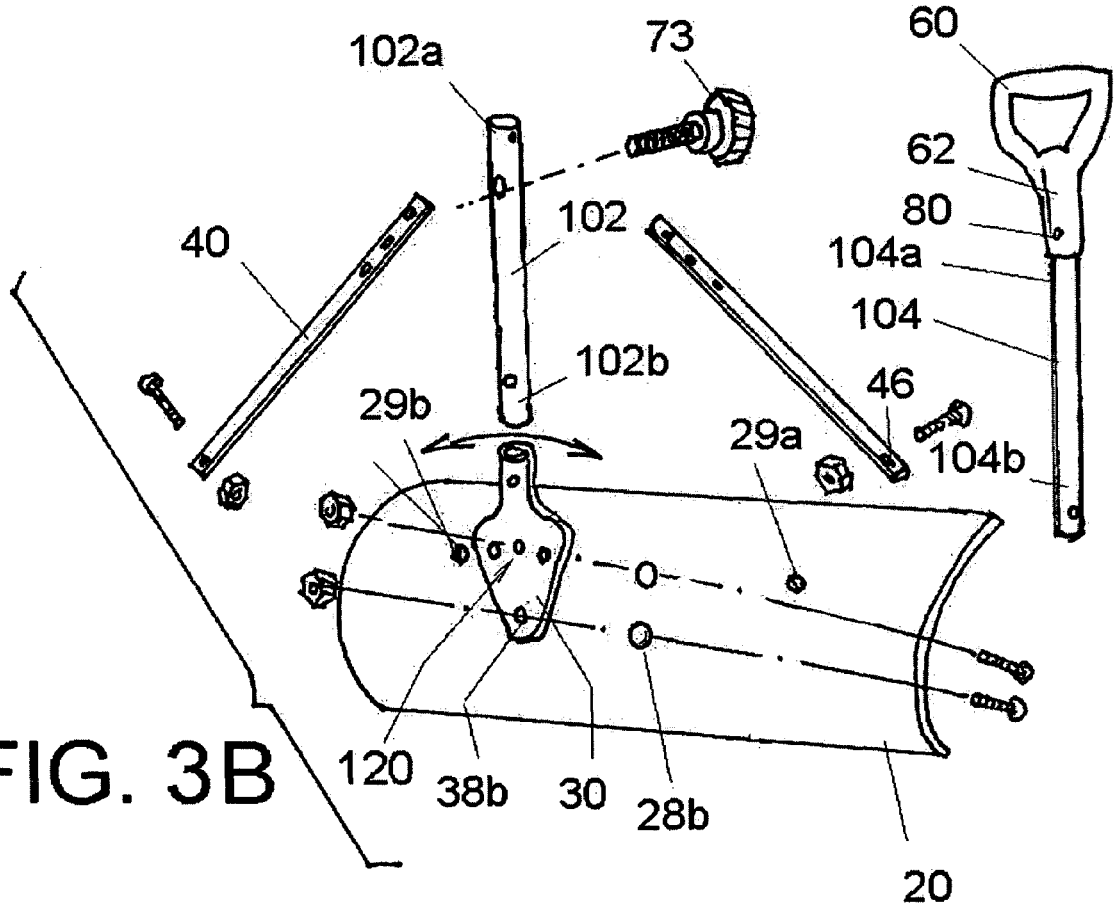
FIG. 3B is an exploded view of the components of the shovel where the bracket contains an arcuately aligned set of holes.

In a fifth embodiment shown in FIG. 3A, the arcuate slot 28*a* is replaced with an arcuately aligned set of holes, generally designated 120. A connector such as a bolt and nut connects the bracket 30 to the blade 20 via aligned holes 28*b* and 38*b*. A bolt, screw or other male fastening means can be inserted through any one of the arcuately aligned set of holes 120 to fasten the blade 20 to the bracket 30. A screw knob may be used for fastening as well. The bracket 30 contains a hole 38*a*. The bracket 30 is pivoted to a desired angle based on a chosen hole in the arcuate set of holes so that the chosen hole is aligned with the bracket hole. Then the bolt is inserted through the chosen hole of the arcuate set of holes and the hole 38*a*, thereby locking bracket 30, and attached stem 52 (or stems 102 and 104) and handle 60, at the desired angle with respect to the blade 20. In FIG. 3B, it is shown that the arcuately aligned set of holes 120 may also be provided in the bracket 30.

As also shown in FIGS. 3A-3B, the snow or ice shovel of the present invention can be provided as a kit and conveniently arranged in a small box. The kit includes the blade 20 and a bracket 30 attached to the rear of the blade 20, two cross braces 40, first and second stems 102, 104 which are interchangeable (or simply one stem 52), and a handle 60. The kit can be easily assembled and disassembled for portability and storage.

Figure 6:
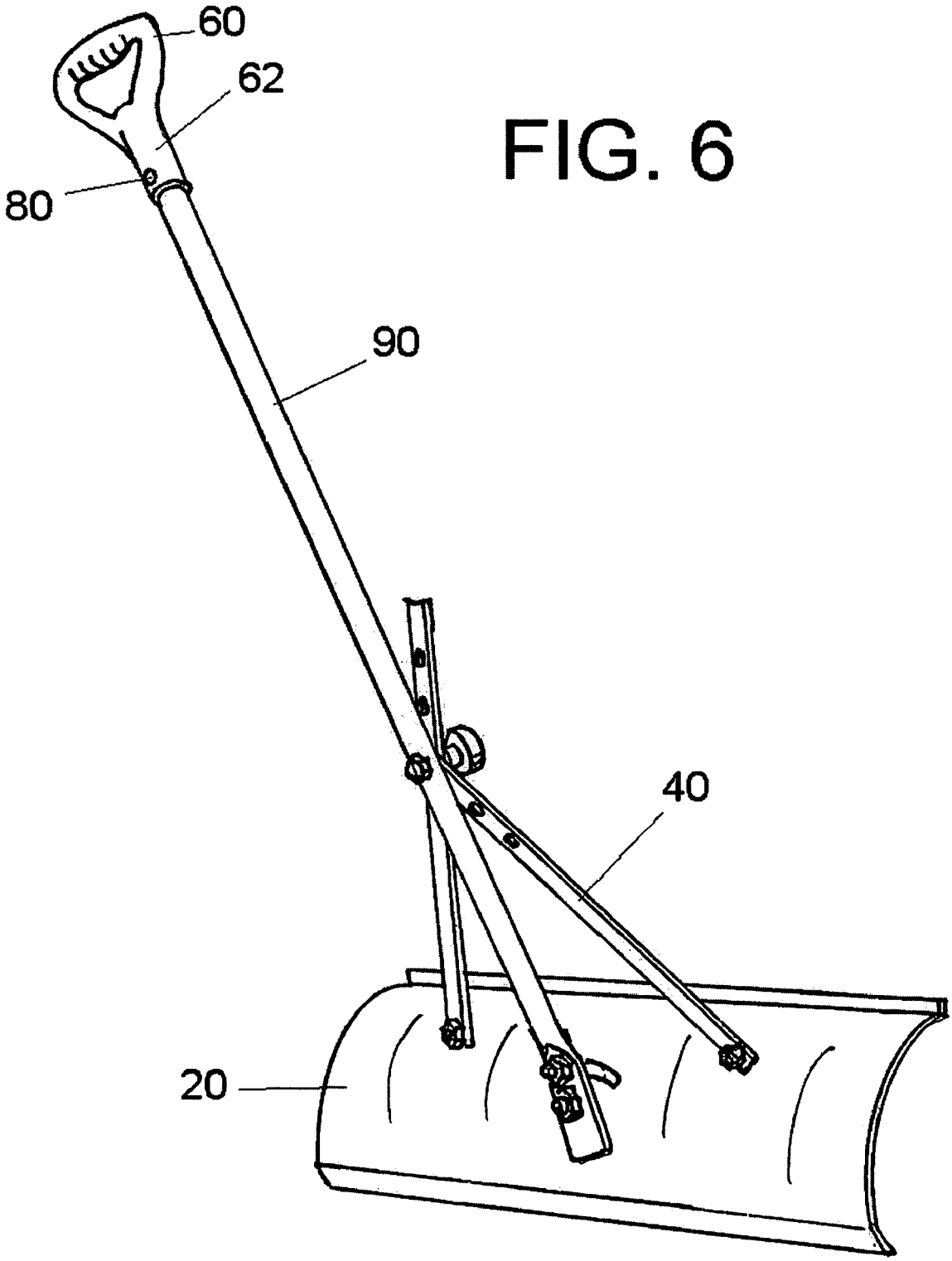
FIG. 6 is a rear perspective view of the shovel of the present invention in which the bracket and stem of the former embodiments are formed into one piece.

In a sixth embodiment shown in FIG. 6, the handle assembly 50 and bracket 30 of the former embodiments are formed as one handle piece 90.

Figure 7:
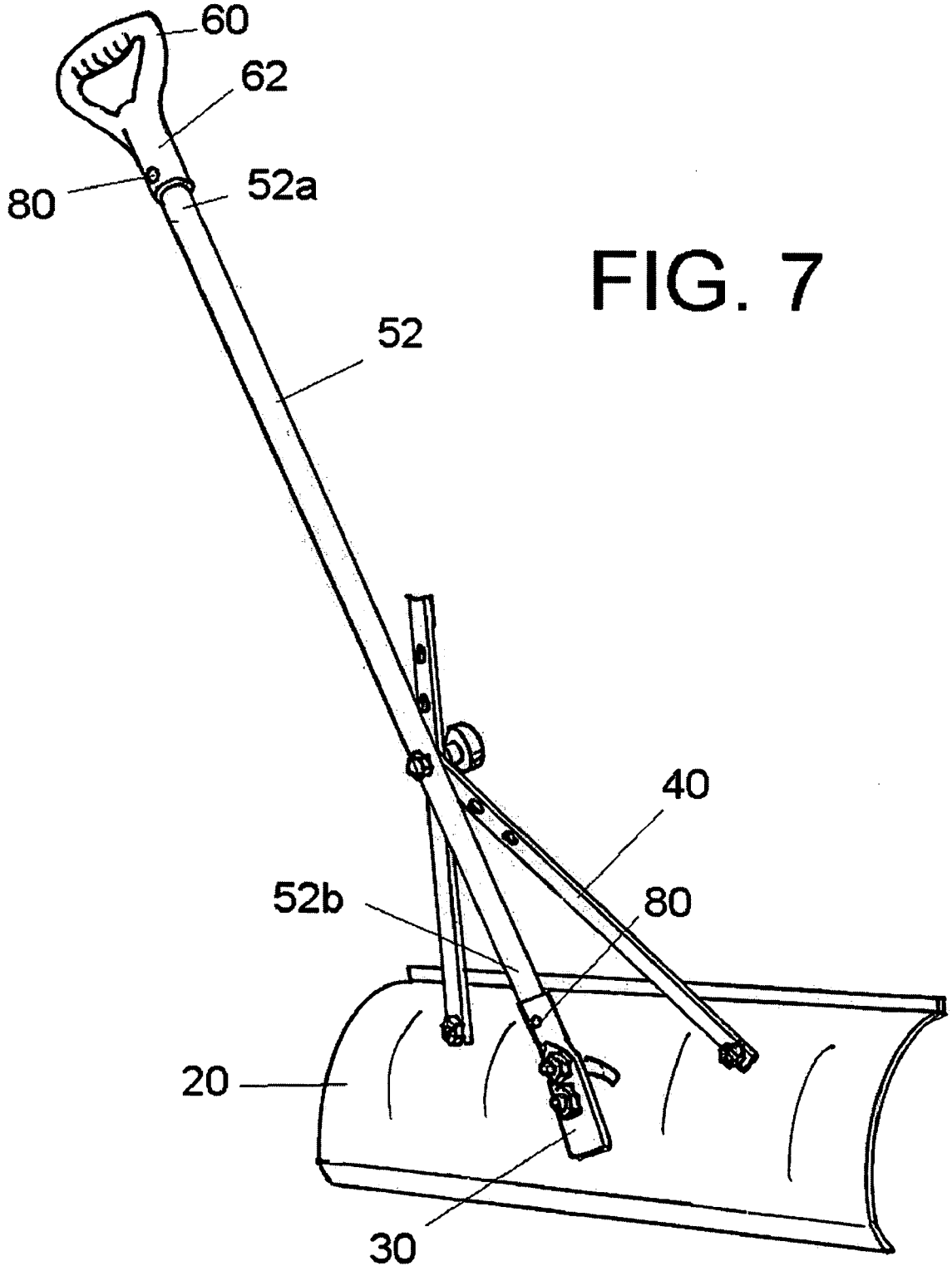
FIG. 7 is a rear perspective view of the shovel of the present invention in which the handle and stem are attached via fastening means such as a bolt and nut instead of thread attachment.

In a seventh embodiment shown in FIG. 7, the handle 60 is attached to the top portion 52*a* of the stem via a bolt and nut or other fastening means 80. The base 62 of the handle 60 has a hole (not shown) and the top portion 52*a* of the stem has a hole (not shown). The base 62 is cylindrical and has a diameter that is larger than the diameter of the top portion 52*a* of the stem. Thus, the stem 52 is inserted into the base 62 of the handle 60 and their respective holes are aligned so that a bolt is inserted through the holes to connect the stem 52 to the base 62 of the handle 60.

Figure 8:
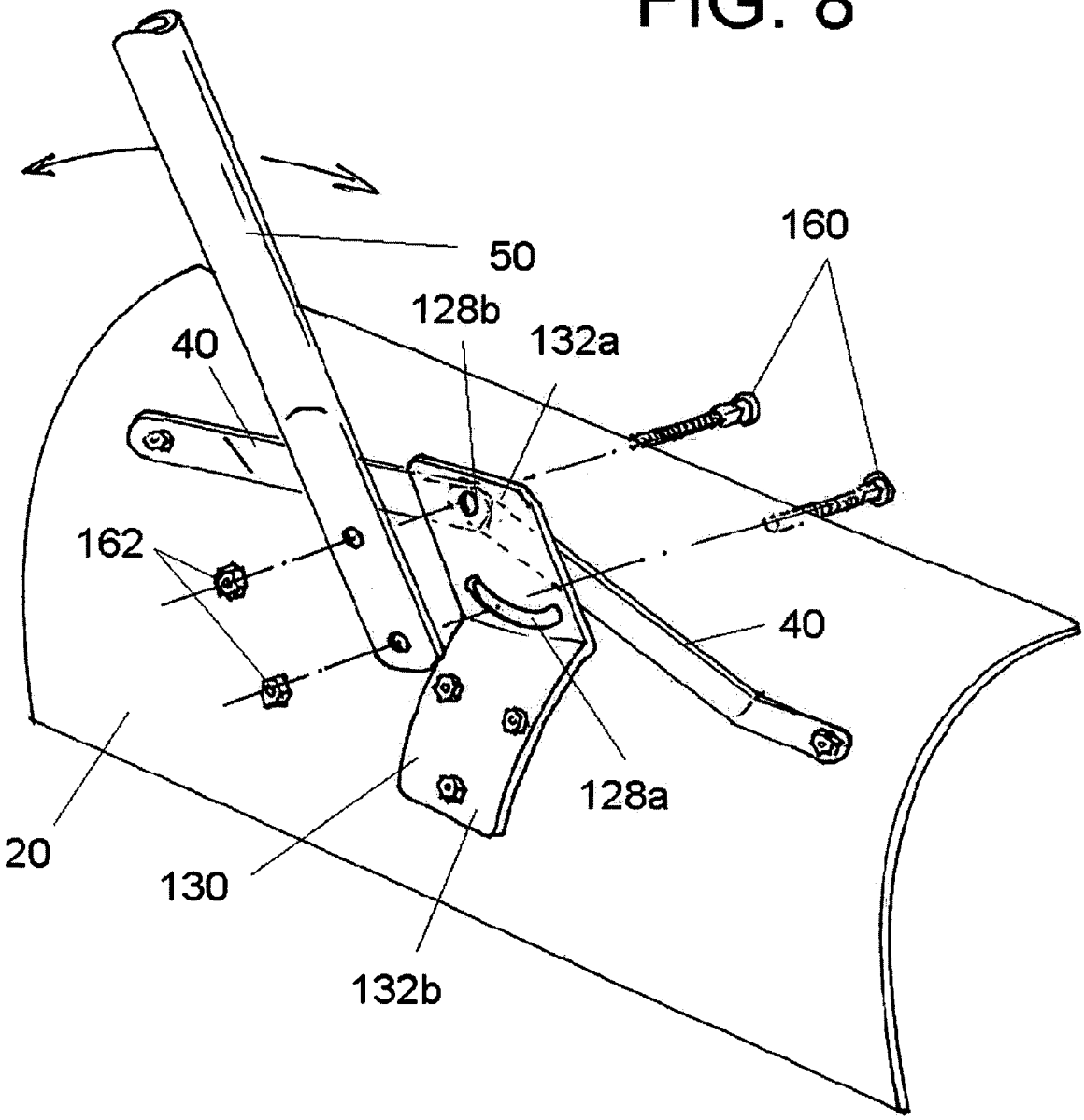
FIG. 8 is a partial rear perspective and partly exploded view of a further embodiment of the invention.

In a eighth embodiment shown in FIG. 8, the arcuate slot in the blade 20 is eliminated and an arcuate slot 128*a* is provided on a bracket 130 that is fixed to the blade. Thus, the bracket 130 is not pivotally attached to the blade 20. However, the handle assembly 50 is still pivotable with respect to the blade 20.

The bracket 130 is fixed to the blade 20 as follows. The bracket 130 comprises a bottom portion 132*b* and a top portion 132*a*. The bottom portion 132*b* is flat or slightly curved to follow the shape of the blade, and includes holes which are aligned with holes in the blade 20 so that bolts and nuts or other fasteners can be used to affix the bottom portion 132*b* of the bracket to the blade 20.

Pivoting connection of the handle assembly 50 with respect to the blade 20 is provided in the following manner. The top portion 132*a* of the bracket 130 contains an arcuate slot 128*a* above or below a hole 128*b* in accordance with the same configurations described for arcuate slot 28*a* and hole 28*b*. The bottom of handle assembly 50, or a second bracket connected to the bottom of the handle assembly 50, has holes for alignment with the arcuate slot 128*a* and the hole 128*b* respectively. Bolt 160, such as stove bolts, are passed through each set of aligned holes and nuts 162 are fastened to the bolts. Therefore, the handle assembly is pivotally connected to the bracket 130 for the center, left or right positions of the handle with respect to the blade.

Figure 9:
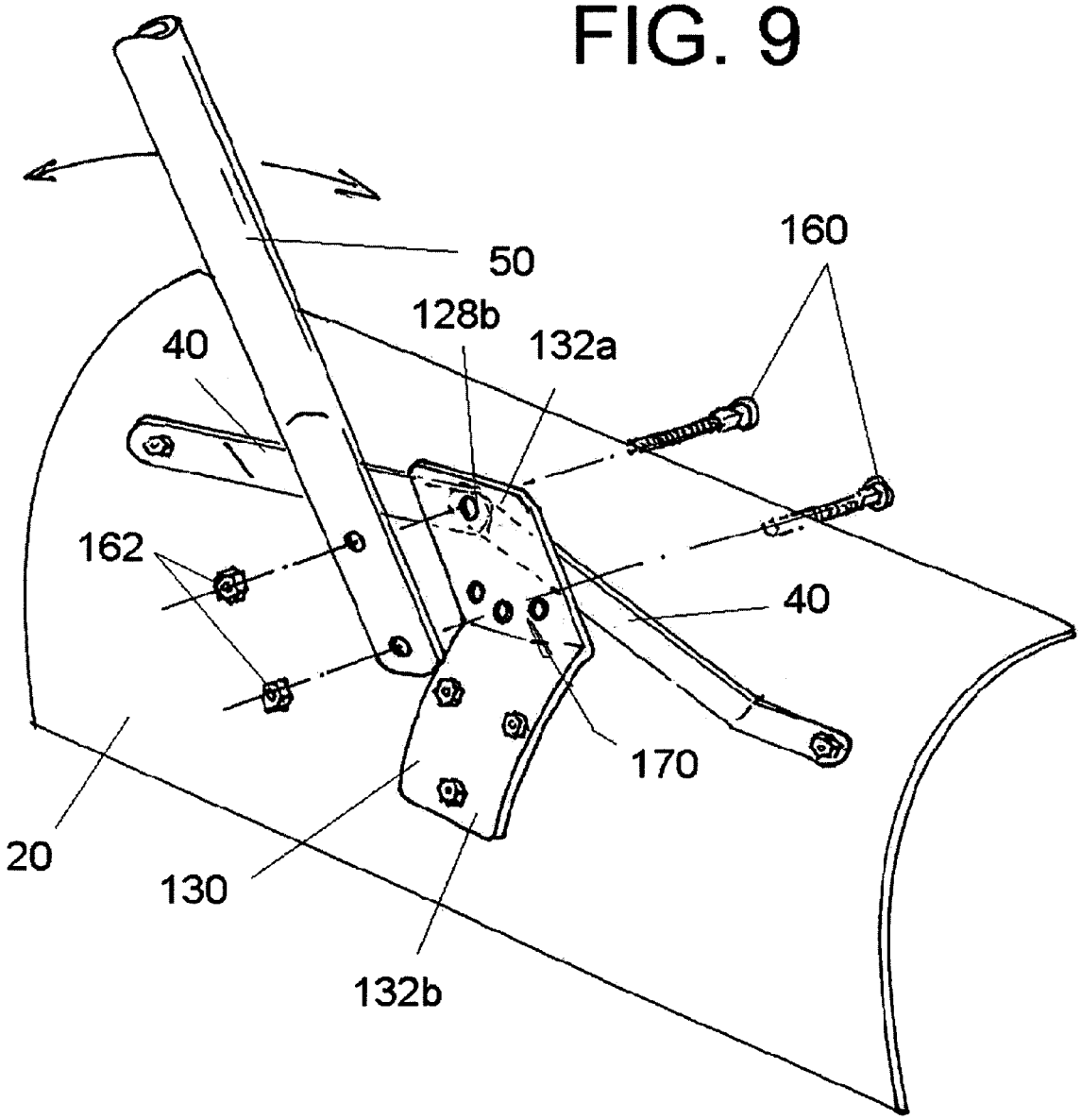
FIG. 9 is a view similar to FIG. 8 of a still further embodiment of the invention.

In a ninth embodiment shown in FIG. 9, the arcuate slot 128*a* of FIG. 8 is replaced with an arcuately aligned set of holes, generally designated 170. The handle assembly is pivoted to a desired angle based on a chosen hole in the arcuate set of holes so that the chosen hole is aligned with the handle assembly hole. Then the bolt is inserted through the chosen hole of the arcuately aligned set of holes and the hole 128*b*, thereby locking bracket 130, and attached stem 52 (or stems 102 and 104) and handle 60, at the desired angle with respect to the blade 20. Screw knobs may be used instead of bolts and nuts.

In the embodiments of FIGS. 8 and 9, cross braces 40 can be provided between the hole 128*b* of the bracket 130 and the opposite sides of the blade to better brace the blade against undesired rotation with respect to the handle assembly.

While specific embodiments of the invention have been shown and described in detail to illustrate the application of the principles of the invention, it will be understood that the invention may be embodied otherwise without departing from such principles.

What is claimed is:

1. A shovel (10) comprising:

an elongated handle assembly (50) having an upper end, a lower end and a handle axis (A);

a blade (20) having a blade axis (B1), the blade being pivotally connected to the lower end of the handle assembly, for pivoting between a first position at a first acute angle (C) between the handle and blade axes on one side of the blade, and a second position at a second acute angle (D) between the handle and blade axes on an opposite side of the blade;

a first elongated cross brace having a lower end connected to one side of the blade, the first cross brace having an upper end detachably connected directly or indirectly to the handle assembly at a bracing location on the handle assembly that is spaced from the blade; and a second elongated cross brace having a lower end connected to an opposite side of the blade, the second cross brace having an upper end detachably connected directly or indirectly to the handle assembly at the bracing location on the handle assembly;

each of the first and second cross braces having, at their respective upper ends, means (70) for bracing the blade in the first and the second positions; and a bracket comprising an upper bracket portion pivotally connected to a lower end of the handle assembly, a lower bracket portion fixed to the blade, the handle assembly being pivotally connected with the blade, the upper bracket portion including an arcuate slot and a handle assembly engaging hole spaced vertically from the arcuate slot, the shovel including fasteners extending through the slot and handle assembly engaging hole, and engaged to the handle assembly for pivotally connecting the handle assembly to the blade.

2. A shovel according to claim 1, wherein the handle assembly comprises a handle fastened to at least one stem.

3. A shovel (10) comprising: an elongated handle assembly (50) having at least one handle at an upper end attached to a stem which leads to a lower end and a handle axis (A); a blade (20) having a blade axis (B1), pivotally connecting means for pivotally connecting the blade to the lower end of the handle assembly, for pivoting between a first position at a first acute angle (C) between the handle and blade axes on one side of the blade, a second position at a second acute angle (D) between the handle and blade axes on an opposite side of the blade, and a third position at substantially a right angle between the handle and blade axes along the center vertical axis (B2) of the blade; a first elongated cross brace having a lower end pivotally connected to one side of the blade, the first cross brace having an upper end detachably connected to the handle assembly at a bracing location on the handle assembly that is spaced from the blade; and a second elongated cross brace having a lower end pivotally connected to an opposite side of the blade, the second cross brace having an upper end detachably connected to the handle assembly at the bracing location on the handle assembly; each of the first and second cross braces having, at their respective upper ends, means (70) for bracing the blade in the first, second, and third positions; and wherein the pivotally connecting means comprises a bracket having an upper bracket portion pivotally connected to a lower handle assembly, a lower bracket portion fixed to the blade, the handle assembly being pivotally connected with the blade, the upper bracket portion including an arcuate slot and a handle assembly engaging hole spaced vertically from the arcuate slot, the shovel including fasteners extending through the slot and handle assembly engaging hole, and engaged to the lower handle assembly for pivotally connecting the handle assembly to the blade.

4. A shovel according to claim 3, wherein the handle is threadingly engaged to the stem.

5. A shovel according to claim 3, wherein the handle is engaged to the stem via a connector passing through holes in both the handle and stem.

6. A shovel (10) comprising:

an elongated handle assembly (50) having at least one handle at an upper end attached to a stem which leads to a lower end and a handle axis (A);

a blade (20) having a blade axis (B1), pivotally connecting means for pivotally connecting the blade to the lower end of the handle assembly, for pivoting between a first position at a first acute angle (C) between the handle and blade axes on one side of the blade, a second position at a second acute angle (D) between the handle and blade axes on an opposite side of the blade, and a third position at substantially a right angle between the handle and blade axes along the center vertical axis (B2) of the blade;

a first elongated cross brace having a lower end connected to one side of the blade, the first cross brace having an upper end detachably connected to the handle assembly at a bracing location on the handle assembly that is spaced from the blade; and a second elongated cross brace having a lower end connected to an opposite side of the blade, the second cross brace having an upper end detachably connected to the handle assembly at the bracing location on the handle assembly;

each of the first and second cross braces having, at their respective upper ends, means (70) for bracing the blade in the first, second, and third positions, wherein the means for bracing comprises a bracket having a curved lower portion laying against and fixed to the blade and an upper flat portion extending at an angle to the lower portion and containing an upper hole and a lower arcuate slot, each cross brace and the handle assembly having an upper hole for aligning with the upper hole of the bracket, an upper fastener for extending through the aligned holes for fixing the cross braces and the handle assembly to the bracket, the handle assembly having a lower hole aligned with the arcuate slot, and a second fastener extending through the arcuate slot and the lower hole of the handle assembly for fixing the handle assembly in one of the first, second and third positions.

7. A snow shovel kit comprising:

an elongated handle assembly (50) having at least one handle at an upper end attached to a stem which leads to a lower end and a handle axis (A);

a blade (20) having a blade axis (B1), a bracket for pivotally connecting the blade to the lower end of the handle assembly, for pivoting between a first position at a first acute angle (C) between the handle and blade axes on one side of the blade, a second position at a second acute angle (D) between the handle and blade axes on an opposite side of the blade, and a third position at substantially a right angle between the handle and blade axes along the center vertical axis (B2) of the blade;

a first elongated cross brace having a lower end for pivotal connection to one side of the blade, the first cross brace having an upper end for detachable connection to the handle assembly at a bracing location on the handle assembly that is spaced from the blade; and a second elongated cross brace having a lower end for pivotal connection to an opposite side of the blade, the second cross brace having an upper end for detachable connection to the handle assembly at the bracing location on the handle assembly;

each of the first and second cross braces having, at their respective upper ends, means (70) for bracing the blade in the first, second, and third positions, wherein the means for bracing comprises a hole in each of the cross braces and the kit includes an upper connector engagable with the handle assembly adjacent the bracing location for passing through aligned holes of the cross braces during assembly of the kit, the bracket having a lower portion laying against and fixed to the blade, and an upper flat portion extending at an angle to the lower portion and containing an upper hole and lower arcuate aperture means for proving at least one opening for a connector, each cross brace and the handle assembly having an upper hole for aligning with the upper hole of the bracket, the upper connector extending through the aligned holes for fixing the cross braces and the handle assembly to the bracket, the handle assembly having a lower hole aligned with the arcuate aperture means, and a second connector extending through the arcuate aperture means and the lower hole of the handle assembly for fixing the handle assembly in one of the first, second and third positions.

* * * * *